US009856602B2

(12) United States Patent
Rossetti

(10) Patent No.: US 9,856,602 B2
(45) Date of Patent: Jan. 2, 2018

(54) TRIPLE PAPERMAKING FABRIC

(71) Applicant: FELTRI MARONE S.P.A., Milan (IT)

(72) Inventor: Clara Rossetti, Marone (IT)

(73) Assignee: Feltri Marone S.p.A., Milan (IT)

( * ) Notice: Subject to any disclaimer, the term of this patent is extended or adjusted under 35 U.S.C. 154(b) by 148 days.

(21) Appl. No.: 14/649,522

(22) PCT Filed: Dec. 10, 2013

(86) PCT No.: PCT/IB2013/060781
§ 371 (c)(1),
(2) Date: Jun. 3, 2015

(87) PCT Pub. No.: WO2014/091409
PCT Pub. Date: Jun. 19, 2014

(65) Prior Publication Data

US 2015/0322628 A1 Nov. 12, 2015

(30) Foreign Application Priority Data

Dec. 10, 2012 (IT) ..... MI2012A002101

(51) Int. Cl.
*D21F 1/00* (2006.01)
*D03D 11/00* (2006.01)

(52) U.S. Cl.
CPC ..... *D21F 1/0027* (2013.01); *D03D 11/00* (2013.01); *D21F 1/0045* (2013.01); *Y10T 442/3472* (2015.04)

(58) Field of Classification Search
CPC .... D21F 1/0027; D21F 1/0036; D21F 1/0045; D21F 1/10; D21F 1/105; D03D 3/04; D03D 1/0094; D03D 11/00; D03D 13/00; D03D 13/004; D03D 25/00
USPC .... 162/348, 900, 902, 903, 904; 139/383 A, 139/383 AA, 425 A
See application file for complete search history.

(56) References Cited

U.S. PATENT DOCUMENTS

2005/0103397 A1* 5/2005 Quigley ..... D21F 1/0045 139/383 A
2006/0096653 A1* 5/2006 Eagles ..... D21F 1/0045 139/383 A

FOREIGN PATENT DOCUMENTS

WO 2010041123 A2 4/2010

OTHER PUBLICATIONS

International Search Report and Written Opinion dated Mar. 25, 2013 from International Patent Application No. PCT/IB2013/060781 filed Dec. 10, 2013.

* cited by examiner

*Primary Examiner* — Eric Hug
(74) *Attorney, Agent, or Firm* — Sunstone IP

(57) ABSTRACT

A triple papermaking fabric, having at least one fabric repeat unit which comprises: a set of sixteen warp yarns or MD yarns, which extend in machine direction and are subdivided into eight top MD yarns eight bottom MD yarns; three top CMD yarns interwoven only with the top MD yarns form a top fabric layer; three bottom CMD yarns interwoven only with the bottom MD yarns to form a bottom fabric layer; three binding yarns interwoven with both the top MD yarns and the bottom MD yarns so as to bind the top layer to the bottom layer; the fabric has a ratio between weft yarns and warp yarns of 3:1.

12 Claims, 4 Drawing Sheets

TRIPLE PAPERMAKING FABRIC

TECHNICAL FIELD

The present invention relates to a papermaking fabric, in particular intended for use as forming fabric in a forming section of a papermaking machine.

BACKGROUND ART

The traditional Fourdrinier papermaking process substantially includes three subsequent steps, carried out in corresponding sections of the papermaking machine: forming section, pressing section, drying section.

In the forming section, an aqueous pulp of cellulose fibers (and possibly other components) is arranged on a so-called forming fabric, loop-closed and supported by rollers. The removing of water from the pulp through the forming fabric leads to the gradual formation of a wet paper material web with still relatively high water content. Further removing of water takes place in the pressing section, in which the paper material is pressed passing through one or more pairs of rollers. The paper material is then sent to the drying section for removing the remaining moisture. The paper thus formed is ready for the subsequent steps of finishing and packaging.

Hereinafter, as customary in the papermaking industry, the terms "machine direction" (abbreviated "MD") and "cross machine direction" (abbreviated "CMD") are used to indicate a direction aligned with the feeding direction of the forming fabric in the papermaking machine and a direction parallel to the surface of the fabric and crosswise (orthogonal) to the feeding direction, respectively. The direction or orientation of the warp and weft yarns of the forming fabric are also indicated with reference to machine direction and cross machine direction.

Furthermore, again as customary in the industry, the surface of the forming fabric in contact with the cellulose pulp (i.e. with the paper material being formed) is the top surface of the fabric and the opposite side facing the machine is the bottom surface. This reference will be adopted also to describe the vertical spatial arrangement of the yarns in the forming fabric.

Some features of the papermaking fabrics are particularly important, such as the supporting capacity and the filtering capacity, especially in the forming section.

Furthermore, papermaking fabrics must have excellent stability also when moved at high speed, high permeability for reducing the amount of water withheld in the pulp when it is transferred to the pressing section and a low energy consumption for moving them.

Although various types of papermaking fabrics, are known, in particular for use in the forming section, there still appears to be margin for improvement in the industry, e.g. in terms of mechanical strength, stability, durability, draining capacity and quality of the formed paper.

DISCLOSURE OF INVENTION

It is therefore an object of the present invention to provide a papermaking fabric which has all these features in satisfactory measure, being in particular fully efficient, highly draining, strong and stable in time, and which ensures the formation of high quality paper.

The present invention therefore relates to a papermaking fabric as disclosed in essential terms in accompanying claim 1 and the additional features of which are disclosed in the dependent claims.

The present invention further relates to the use of such a fabric in a papermaking machine, and specifically in the forming section of the machine, as well as a papermaking process using such a fabric, as disclosed in accompanying claim 10.

BRIEF DESCRIPTION OF THE DRAWINGS

The invention is further described in the following non-limitative embodiments, with reference to the accompanying figures, in which.

BEST MODE FOR CARRYING OUT THE INVENTION

Figure 1:
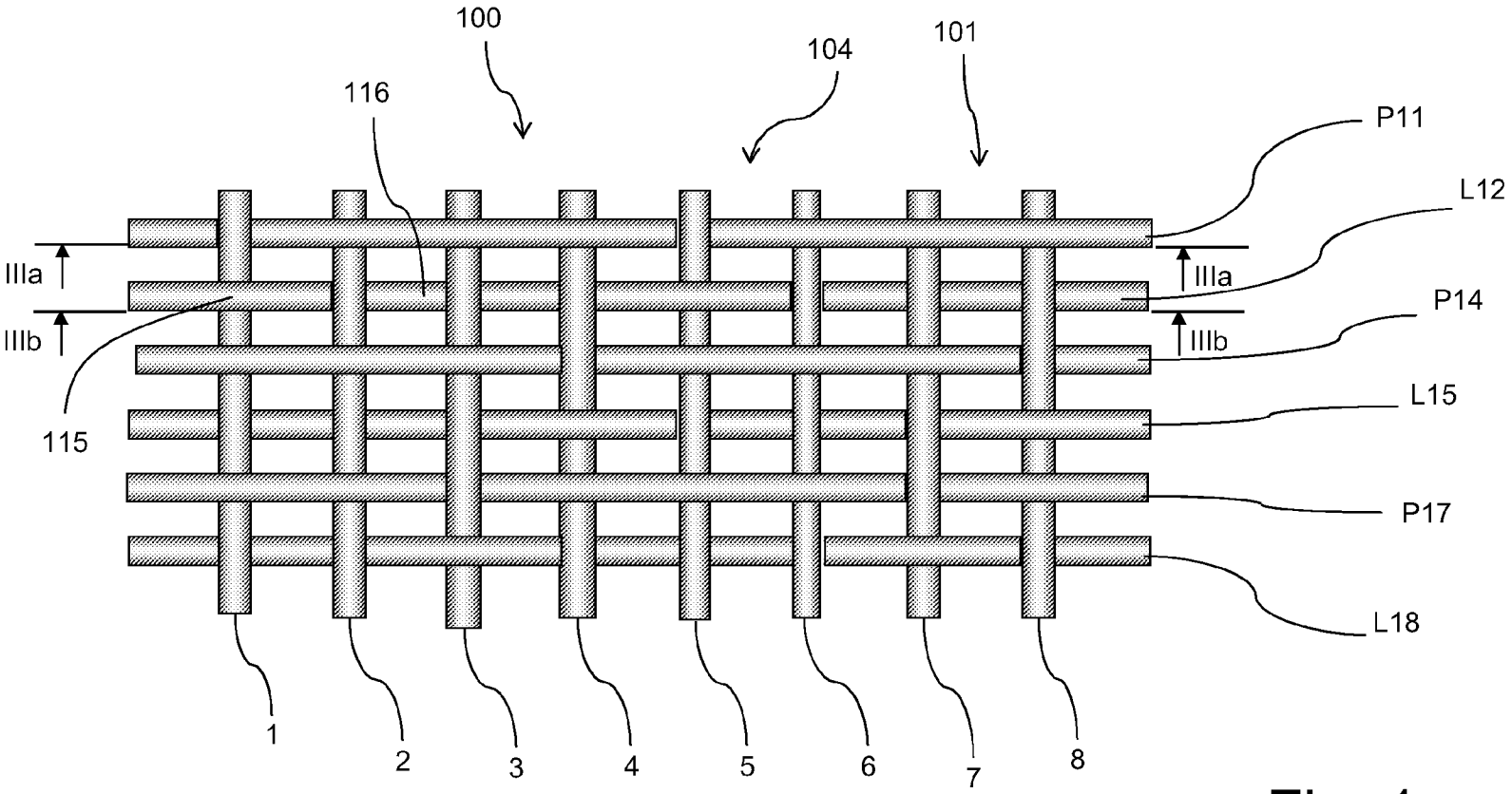
FIG. 1 is a diagrammatic top plan view of top layer of a fabric according to the invention (showing one fabric repeat unit)

With reference to figures from 1 to 3, reference numeral 100 indicates a papermaking fabric as a whole, in particular a forming fabric to be used in the forming section of a papermaking machine.

Figure 2:
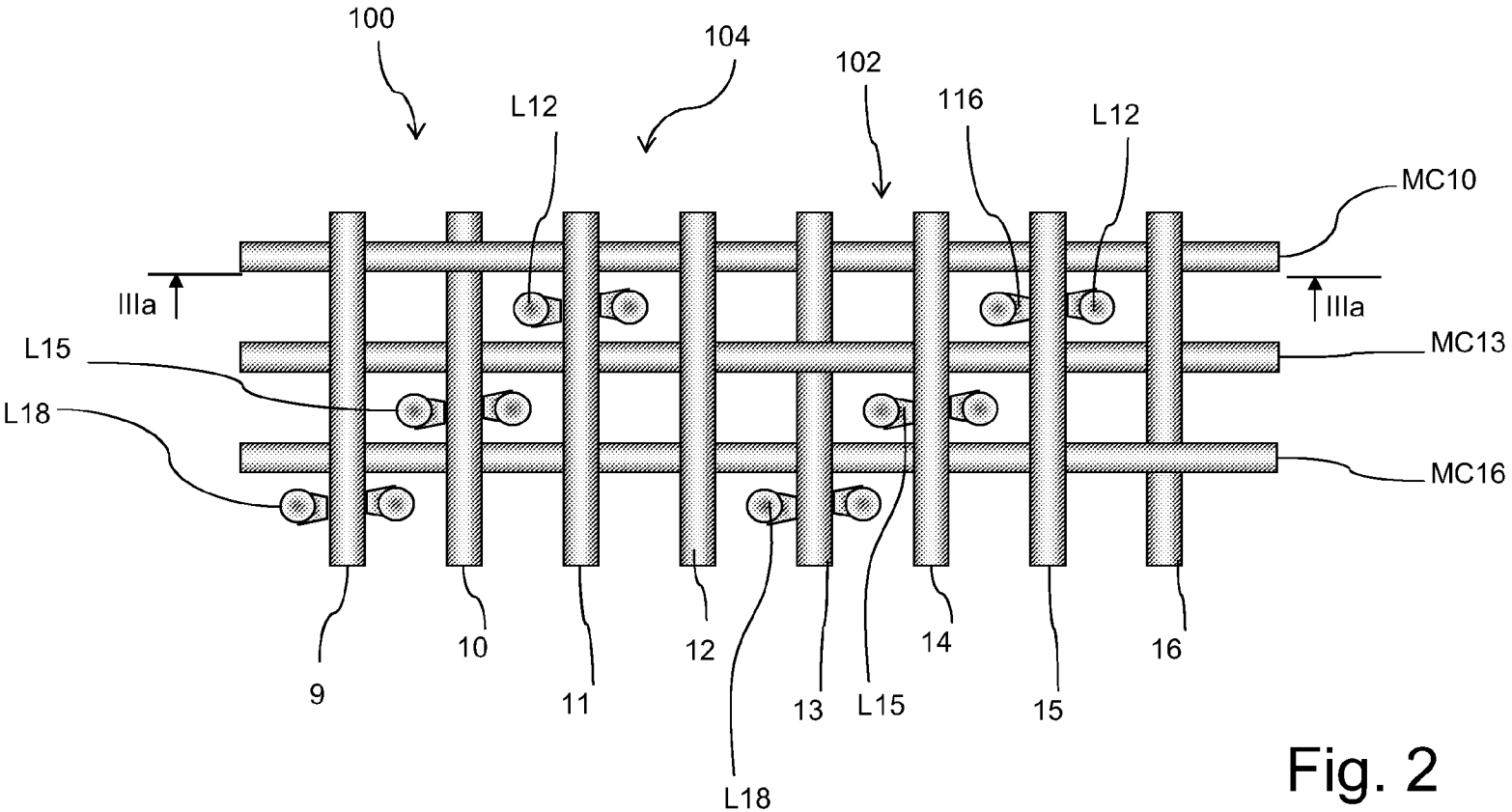
FIG. 2 is a diagrammatic top plan view of a bottom layer of the fabric in FIG. 1.

The fabric 100 is a triple sixteen harness fabric and comprises a top layer 101 and a bottom layer 102 formed, as customary, by corresponding repeat units which form together a fabric repeat unit 104; FIGS. 1 and 2 show a single fabric repeat unit 104; it is understood that in commercial and industrial applications the unit 104, as the repeat units of the single layers 101, 102, may be repeated several times, both in machine direction and in cross machine direction, for forming a fabric 100 of suitable size for use on a papermaking machine.

In general, the fabric 100 is formed by longitudinal warp yarns which extend in machine direction (MD) and by crosswise weft yarns, substantially orthogonal to the previous yarns, which extend in cross machine direction (CMD). Hereinafter (and as customary in the industry), the longitudinal warp yarns which extend in machine direction will be named "MD yarns", and the crosswise weft yarns which extend in cross machine direction will be named "CMD yarns" for the sake of simplicity.

In the case in point, a fabric repeat unit 104 of the fabric 100 includes: sixteen warp yarns or MD yarns 1-16, which are subdivided into eight top MD yarns 1-8 and eight bottom MD yarns 9-16; and nine weft yarns or CMD yarns P11, P14,P17; MC10,MC13,MC16; L12,L15,L18, and specifically three top CMD yarns P11,P14,P17, three bottom CMD yarns MC10,MC13,MC16 and three binding yarns L12,L15, L18, comprising respective support portions 115 and respective binding portions 116.

The interweaving or weave of these yarns for forming the fabric 100 is described in detail below.

The top layer 101 (FIG. 1) includes the top MD yarns 1-8 and the top CMD yarns P11,P14,P17, as well as the support portions 115 of the binding yarns L12,L15,L18.

The bottom layer 102 (FIG. 2) comprises the bottom MD yarns 9-16 and the bottom CMD yarns MC10,MC13,MC16, as well as the binding portions 116 of the binding yarns L12,L15,L18 which extend to bind the bottom MD yarns 9-16.

The fabric 100 has only one warp: the top MD yarns 1-8 and the bottom MD yarns 9-16 form a single warp, i.e. a single warp is mounted on the loop which makes the fabric 100; the MD yarns 1-16 alternatively form the top layer (top MD yarns 1-8) and the bottom layer (bottom MD yarns 9-16) according to their weave with the weft yarns (top CMD yarns P11,P14,P17; bottom CMD yarns MC10,MC13, MC16; binding yarns L12,L15,L18).

The top CMD yarns P11,P14,P17 are interwoven only with the top MD yarns 1-8; the bottom CMD yarns MC10, MC13,MC16 are interwoven only with the bottom MD yarn 9-16. The binding yarns L12,L15,L18 bind the top MD yarns 1-8 to the bottom MD yarns 9-16.

Figure 3A:
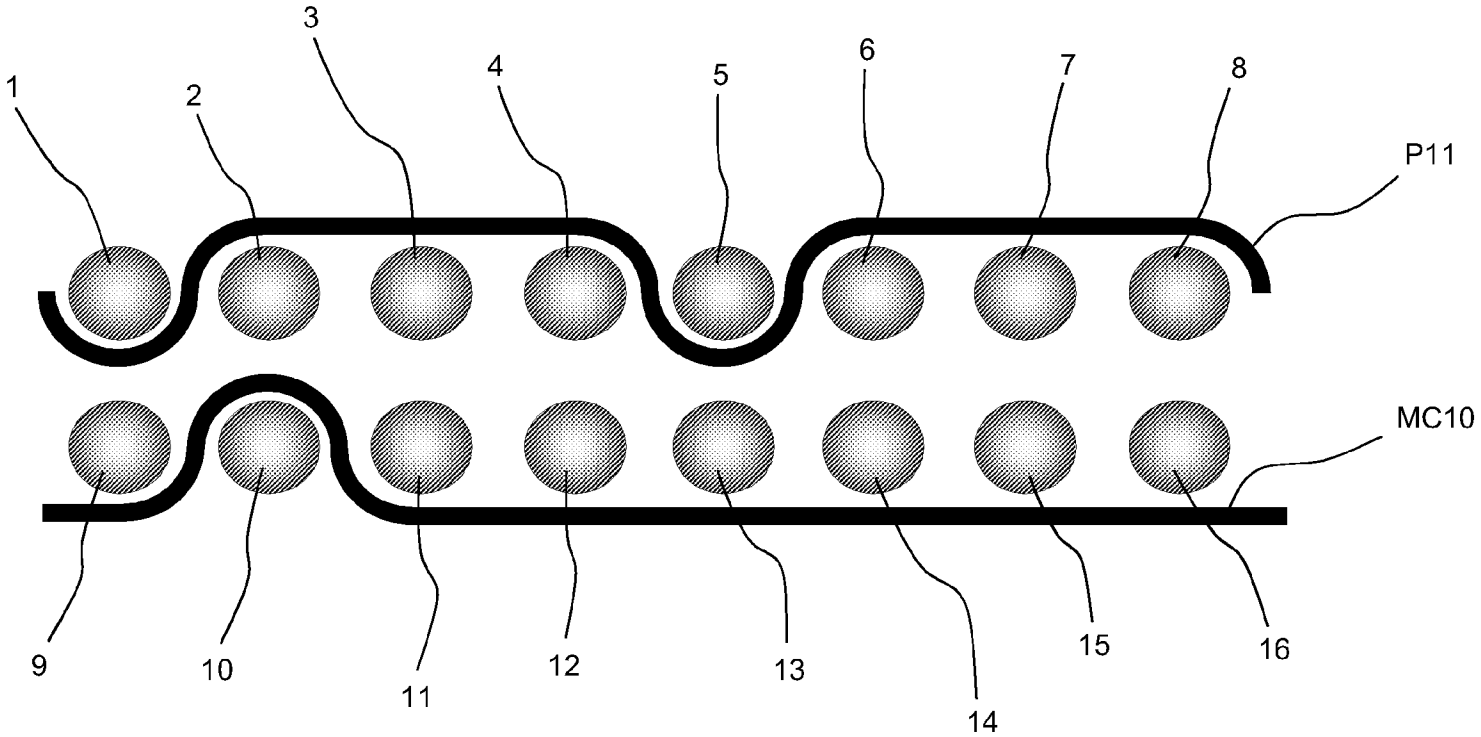
FIGS. 3*a*, 3*b* are section views taken along plotting planes IIIa-IIIa, IIIb-IIIb of FIGS. 1 and 2, respectively.

The top MD yarns 1-8 and the top CMD yarns P11,P14, P17 are interwoven so that each top CMD yarn P11,P14,P17 passes alternatively over three top MD yarns and under one top MD yarn, specifically passing under a top MD yarn and over the following three top MD yarns, and thus again under a top MD yarn and under the following three top MD yarns. For example, as shown in FIG. 3*a*, the top CMD yarn P11 passes under the top MD yarn 1, over the top MD yarns 2, 3, 4, under the top MD yarn 5, over the top MD yarns 6, 7, 8 and so forth.

The same pattern is followed by all top CMD yarns P11,P14,P17, but the top CMD yarns are offset in cross machine direction, precisely by two top MD yarns. Layers 101, 102 are joined and bound to one another to form the fabric 100 by means of binding yarns L12,L15,L18.

Each binding yarn L12,L15,L18 in a fabric repeat unit 104 comprises a supporting portion 115, which is interwoven with the top MD yarns 1-8, and a binding portion 116, which is arranged under the top MD yarns 1-8 and is interwoven with the bottom MD yarns 9-16.

In the example shown, each binding yarn L12,L15,L18 is arranged between two adjacent top CMD yarns P11,P14, P17. In the fabric repeat unit 104 there are an equal number (three, in the case in point) of top CMD yarns P11,P14,P17 and of binding yarns L12,L15,L18, as well as of bottom CMD yarns MC10,MC13,MC16; and each binding yarn L12,L15,L18 is adjacent to a top CMD yarn P11,P14,P17 and forms a pair therewith; in each of these pairs, formed by a top CMD yarn P11,P14,P17 and by a binding yarn L12, L15,L18, the binding yarn passes over the top MD yarns under which the adjacent top CMD yarn passes, and vice versa passes under the top MD yarns over which the adjacent top CMD yarn passes.

For example, in the pair formed by the top CMD yarn P11 and by the binding yarn L12, the top CMD yarn P11 passes under the top MD yarns 1 and 5 and over the top MD yarns 2-4 and 6-8, while the binding yarn L12 passes over the top MD yarns 1, 5 and passes under the top MD yarns 2-4 and 6-8.

The other binding yarns L15,L18 are interwoven with the same pattern but are offset in cross machine direction by two positions (i.e. by two top or bottom CMD yarns).

In this manner, the binding yarns L12,L15,L18 do not contribute in practice to the paper supporting function, because their support portions 115 have a limited extension passing over only single top MD yarns which are widely distanced apart.

The binding yarns L12,L15,L18 instead have the function of joining the two layers 101, 102 of the fabric 100.

In the example shown in FIGS. 1-3, each binding yarn L12,L15,L18 binds, in the fabric repeat unit 104, two top MD yarns and two bottom MD yarns; in particular, each binding yarn L12,L15,L18 binds a top MD yarn and a bottom MD yarn which are offset by two positions in cross machine direction; for example, the binding yarn L12 passes over the top MD yarn 1 and under the bottom MD yarn 11, which is offset by two positions in cross machine direction with respect to the top MD yarn 1.

Each binding yarn L12,L15,L18 thus binds two top MD yarns and a bottom MD yarn arranged in the middle of the two top MD yarns bound by the same binding yarn, passing over the top MD yarn and under the bottom MD yarn displaced by two positions in cross machine direction with respect to the top MD yarn.

Each binding yarn L12,L15,L18 passes over a top MD yarn and under the following three top MD yarns, and thus again over the following top MD yarn and so forth; and under a bottom MD yarn and over the following three bottom MD yarns, and so forth.

The same pattern is followed by all the binding yarns L12,L15,L18, but the binding yarns are offset in cross machine direction, precisely by two top MD yarns.

The interweave of the binding yarns L12,L15,L18 with the top MD yarns 1-8 and the bottom MD yarns 9-16 may take different forms.

In the example shown in FIG. 1, the top layer has a four harness satin structure.

With reference again to FIG. 2, the bottom layer 102 comprises the bottom MD yarns 9-16, the bottom CMD yarns MC10,MC13,MC16 and the binding portions 116 of the binding yarns L12,L15,L18.

The bottom CMD yarns MC10,MC13,MC16 are interwoven with the bottom MD yarns 9-16 in a "over-1/under-7" sequence.

For example, as shown in FIG. 3*a*, the bottom CMD yarn MC10 passes over the bottom MD yarn 10 and under the bottom MD yarns 9 and 11-16.

The other bottom CMD yarns follow a similar "over-1/under-7" pattern with respect to the bottom MD yarns, but each is offset with respect to the adjacent bottom CMD yarn in cross machine direction in particular by three positions, i.e. by three bottom MD yarns. The bottom CMD yarns MC10,MC13,MC16 therefore pass over the bottom MD yarns 10, 13, 16 respectively, and under the others.

The bottom layer 102 therefore has an eight harness satin structure.

The bottom layer 102 also includes (FIG. 3) the binding portions 116 of the binding yarns L12,L15,L18. In the fabric repeat unit 104, each binding yarn L12,L15,L18 passes with its own binding portion 116 under a lower MD yarn 9-16 so as to define a "under-1/over-3" sequence with respect to the bottom MD yarns 9-16.

For example, the binding yarn L12 (FIG. 3*b*) passes under the lower MD yarns 11 and 15 and over al the other bottom MD yarns 9-10, 12-14, 16.

The other binding yarns L15,L18 follow the same "under-1/over-3" but a preferably offset with respect to the binding yarn L12, in particular by three bottom MD yarns.

The fabric 100 has a ratio between weft yarns and warp yarns of 3:1.

It is defined as the ratio between weft yarns and warp yarns the ratio between the number of weft yarns which are repeated to form the fabric in cross machine direction and the number of warp yarns which are repeated in cross machine direction to form the fabric.

In the fabric 100 there are three weft yarns for each warp yarn; this corresponds to the manufacturing method of the fabric: in the weaving on the loom, three weft yarns are inserted for each warp yarn.

Crosswise (i.e. perpendicularly to machine direction), the fabric 100 thus has a sequence of three weft yarns which are repeated in machine direction for each warp yarn (which is alternatively a top yarn or a bottom yarn according to the weaving with the weft yarns).

In other words, the repeat unit 104 of the fabric is formed by a single warp yarn (MD yarn) for every three weft yarns (CMD yarn): for every warp yarn (which may be a top MD yarn 1-8 or a bottom MD yarn 9-16, according to the weave with the warp CMD yarns), there are indeed a top CMD yarn (one of either P11,P14,P17), a bottom CMD yarn (one of MC10,MC13,MC16) and a binding yarn (one of L12,L15, L18).

Figure 3B:
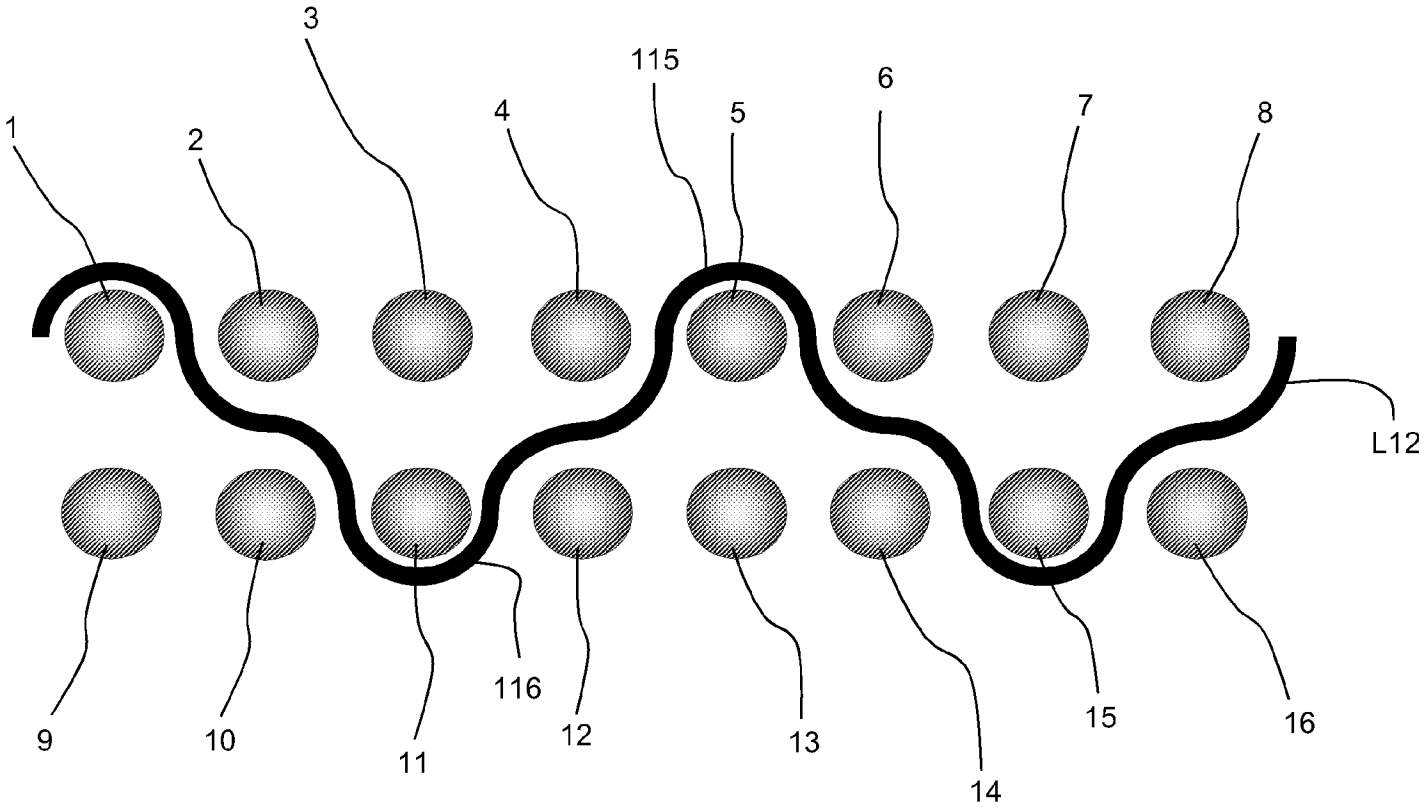

The warp yarns are diagrammatically shown in FIGS. 3*a*, 3*b* in pairs to form two layers; in fact, the warp yarns take this arrangement by effect of the weaving with the weft yarns, but only one warp yarn is repeated in cross machine direction.

The 3:1 ratio between the weft yarns and the warp yarns reflects the weaving method of the fabric 100; three consequent weft yarns are inserted at each ledge (or insertion) of the fabric forming loom on each weft yarn.

The fabric 100 therefore has one warp yarn every three weft insertions.

Each top or bottom MD yarn is associated in each loom insertion or ledge, to a top CMD yarn, a bottom CMD yarn and a binding yarn.

A person skilled in the art will recognize that the fabrics according to the present invention may take different forms.

For example, with respect to the description above, the number and/or the position of the pairs of binding yarns may be varied with respect to the number and/or position the top CMD yarns (e.g. there may be one binding yarn for every two or three top CMD yarns, or there may be two or three or more binding yarns for every top CMD yarn).

Also the number of the top and bottom CMD yarns in the fabric repeat unit may vary with respect to the that described and illustrated by way of example only.

Furthermore, all weave patterns or weaves described for the layers 101, 102 may differ from those illustrated and described; for example, the top surface of the fabric must not necessarily be formed by a four harness satin structure as shown, but may be of plain weave type, twill etc; and the bottom surface on the fabric does not necessarily need to be an eight harness satin structure, but may be any other form, such as a broken weave, a plain weave, a broken twill, a twill, etc. Other further variants of weave patterns may be used in the fabric according to the present invention.

Yarns of various shapes (e.g. with round or flat section) and sizes may also be used.

The shape of the yarns used in the fabric of the invention may be varied according to the properties intended to be imparted to the end product. For example, the yarns may be monofilament yarns, flat monofilament yarns, multifilament yarns, twisted multifilament or monofilament yarns, yarns of any type, or any combination thereof. The materials with which yarns are made may be those commonly used in the field. For example, polyester, polyamide, polyamide/polyester yarns or the like may be used. A person skilled in the art may select the materials of the yarns also according to the specific application for which the end product is intended.

For example, the top and bottom MD yarns, the top CMD yarns and the binding yarns may have (reciprocally equivalent or different) diameter from approximately 0.10 to 0.35 mm; the bottom MD yarns may have diameter from approximately 0.10 and 0.50 mm; it is understood that these sizes are only examples, and other sizes may be used according to specific needs.

The mesh (i.e. the size of the mesh) of the fabric may also vary.

For example, the mesh size of the top surface must be comprised between approximately 17×17 and 19×30 (warp yarns per cm×weft insertions per cm) and the total mesh size may vary from approximately 34×26 to 38×60 (warp yarns per cm×weft insertions per cm).

A fabric with 3:1 ratio and eight harness satin structure bottom layer according to the invention has the features shown in table 1.

TABLE 1

| YARN | Size |
|---|---|
| MD divided into: | 0.27 mm |
| Top MD | 0.27 mm |
| Bottom MD | 0.27 mm |
| Binding | 0.25 mm |
| Top CMD | 0.30 mm |
| Bottom CMD | 0.50 mm |
| Mesh (top surface) | 18.5 × 22 * |
| Mesh (total) | 36 × 33 * |

* warp yarns per cm × weft mesh per cm

According to an aspect of the invention, the above-described fabric 100 is used in a papermaking process, in particular in the forming section of a papermaking machine. The process includes the steps of:

(a) preparing a papermaking fabric as described above;

(b) applying an aqueous cellulose pulp and/or a paper material to be formed on the top surface of the fabric; and (c) removing water from the pulp and/or the paper material to be formed.

Such a process is for the rest substantially well known by a person skilled in the art and therefore further details with this regard are not necessary.

Moreover, it is understood that further changes and variations may be made to the description provided herein, without departing from the scope of the invention as defined in the appended claims.

The invention claimed is:

1. A triple papermaking fabric, having at least one fabric repeat unit that comprises:

a set of sixteen warp yarns or machine direction (MD) yarns, that extend in machine direction (MD) and subdivide in eight top MD yarns and eight bottom MD yarns;

a set of nine weft yarns or cross machine direction (CMD) yarns (P11,P14,P17; MC10,MC13,MC16; L12,L15, L18), that extend in cross machine direction and specifically include: three top CMD yarns (P11,P14,P17), three bottom CMD yarns (MC10,MC13,MC16) and three binding yarns (L12,L15,L18);

wherein:

the top CMD yarns (P11,P14,P17) are interwoven only with the top MD yarns to form a top layer;

the bottom CMD yarns (MC10,MC13,MC16) are interwoven only with the bottom MD yarns (9-16) to form a bottom layer;

the binding yarns are interwoven with both top MD yarns (1-8) and bottom MD yarns so as to bind the top layer with the bottom layer;

and wherein the fabric has a ratio between weft yarns and warp yarns of 3:1, wherein each top CMD yarn (P11,P14,P17) passes alternately under a top MD yarn and above the following three top MD yarns, and so on.

2. A fabric according to claim 1, wherein in the fabric repeat unit, for each warp yarns or MD yarns, that is alternatively either a top MD yarn or a bottom MD yarn according to the weaving with the weft yarns, there are one top CMD yarn (P11,P14,P17), one bottom CMD yarn (MC10,MC13,MC16) and one binding yarn (L12,L15,L18).

3. A fabric according to claim 1, wherein the fabric has a single warp, the warp yarns being divided alternatively in top MD yarns, that form the top layer, and bottom MD yarns, that form the bottom layer, depending on the weaving with the weft yarns (P11,P14,P17; MC10,MC13,MC16; L12, L15,L18).

4. A fabric according to claim 1, wherein each binding yarn (L12,L15,L18) is arranged between two adjacent top CMD yarns (P11,P14,P17) and in the fabric repeat unit is interwoven with two top MD yarns and two bottom MD yarns.

5. A fabric according to claim 1, wherein in the fabric repeat unit there are an equal number of top CMD yarns (P11,P14,P17), of binding yarns (L12,L15,L18), and of bottom CMD yarns (MC10,MC13,MC16).

6. A fabric according to claim 1, wherein each binding yarn (L12,L15,L18) binds, in the fabric repeat unit, four MD yarns and specifically two top MD yarns and two bottom MD yarns; the four MD yarns bound by each binding yarn (L12,L15,L18) being all offset of two positions in cross machine direction with respect to one another.

7. A fabric according to claim 1, wherein each binding yarn (L12,L15,L18) passes over a top MD yarn and under the following three top MD yarns, and so on; and under a bottom MD yarn and above the following three bottom MD yarns, and so on.

8. A fabric according to claim 1, wherein the top layer has a four harness satin structure.

9. A fabric according to claim 1, wherein the bottom layer has a eight harness satin structure.

10. A papermaking method, comprising the steps of:

(a) providing a papermaking fabric according to claim 1;

(b) applying on the fabric an aqueous cellulose pulp and/or a paper material to be formed; and (c) removing water from the pulp and/or the paper material.

11. A triple papermaking fabric, having at least one fabric repeat unit that comprises:

a set of sixteen warp yarns or machine direction (MD) yarns, that extend in machine direction (MD) and subdivide in eight top MD yarns and eight bottom MD yarns;

a set of nine weft yarns or cross machine direction (CMD) yarns (P11,P14,P17; MC10,MC13,MC16; L12,L15, L18), that extend in cross machine direction and specifically include: three top CMD yarns (P11,P14,P17), three bottom CMD yarns (MC10,MC13,MC16) and three binding yarns (L12,L15,L18);

wherein:

the top CMD yarns (P11,P14,P17) are interwoven only with the top MD yarns to form a top layer;

the bottom CMD yarns (MC10,MC13,MC16) are interwoven only with the bottom MD yarns (9-16) to form a bottom layer;

the binding yarns are interwoven with both top MD yarns (1-8) and bottom MD yarns so as to bind the top layer with the bottom layer;

and wherein the fabric has a ratio between weft yarns and warp yarns of 3:1, wherein each binding yarn (L12,L15,L18) is adjacent to a top CMD yarn (P11,P14,P17) and form with such a top CMD yarn a pair; in each pair formed by a top CMD yarn (P11,P14,P17) and a binding yarn (L12,L15,L18) adjacent thereto, the binding yarn passes over the top MD yarns under which the adjacent top CMD yarn passes, and, vice versa, passes under the top MD yarns over which the adjacent top CMD yarn passes.

12. A triple papermaking fabric, having at least one fabric repeat unit that comprises:

a set of sixteen warp yarns or machine direction (MD) yarns, that extend in machine direction (MD) and subdivide in eight top MD yarns and eight bottom MD yarns;

a set of nine weft yarns or cross machine direction (CMD) yarns (P11,P14,P17; MC10,MC13,MC16; L12,L15, L18), that extend in cross machine direction and specifically include: three top CMD yarns (P11,P14,P17), three bottom CMD yarns (MC10,MC13,MC16) and three binding yarns (L12,L15,L18);

wherein:

the top CMD yarns (P11,P14,P17) are interwoven only with the top MD yarns to form a top layer;

the bottom CMD yarns (MC10,MC13,MC16) are interwoven only with the bottom MD yarns (9-16) to form a bottom layer;

the binding yarns are interwoven with both top MD yarns (1-8) and bottom MD yarns so as to bind the top layer with the bottom layer;

and wherein the fabric has a ratio between weft yarns and warp yarns of 3:1, wherein the bottom CMD yarns (MC10,MC13,MC16) are interwoven with the bottom MD yarns with a sequence "over-1/under-7".

* * * * *